US010337126B2

(12) United States Patent
Meier

(10) Patent No.: US 10,337,126 B2
(45) Date of Patent: Jul. 2, 2019

(54) NONWOVEN LAYING APPARATUS AND NONWOVEN LAYING METHOD

(71) Applicant: AUTEFA SOLUTIONS GERMANY GMBH, Friedberg (DE)

(72) Inventor: Andreas Meier, Affing (DE)

(73) Assignee: AUTEFA SOLUTIONS GERMANY GMBH, Friedburg (DE)

( * ) Notice: Subject to any disclaimer, the term of this patent is extended or adjusted under 35 U.S.C. 154(b) by 483 days.

(21) Appl. No.: 15/034,305

(22) PCT Filed: Nov. 5, 2014

(86) PCT No.: PCT/EP2014/073755
§ 371 (c)(1),
(2) Date: May 4, 2016

(87) PCT Pub. No.: WO2015/067627
PCT Pub. Date: May 14, 2015

(65) Prior Publication Data

US 2016/0298274 A1 Oct. 13, 2016

(30) Foreign Application Priority Data

Nov. 5, 2013 (DE) ..... 20 2013 104 946 U

(51) Int. Cl.
*D01G 25/00* (2006.01)
*D04H 1/70* (2012.01)
*D04H 3/05* (2006.01)

(52) U.S. Cl.
CPC ..... *D01G 25/00* (2013.01); *D04H 1/70* (2013.01); *D04H 3/05* (2013.01)

(58) Field of Classification Search
CPC . D04H 1/70; D04H 1/74; D04H 11/04; D04H 1/736; D04H 3/04; D04H 3/05; D01G 25/00
(Continued)

(56) References Cited

U.S. PATENT DOCUMENTS 5,060,347 A * 10/1991 Beckers ..... D01G 15/36 19/163
5,353,477 A * 10/1994 Hille ..... D01G 25/00 19/163
(Continued)

FOREIGN PATENT DOCUMENTS

DE 20 2007 009305 U1 10/2007
DE 20 2010 008 748 U1 1/2012
(Continued)

OTHER PUBLICATIONS

English language machine translation of DE 202007009305 (doc. pub. Oct. 2007), 5 pages.*

*Primary Examiner* — Amy Vanatta
(74) *Attorney, Agent, or Firm* — McGlew and Tuttle, P.C.

(57) ABSTRACT

A nonwoven laying apparatus (3) and a nonwoven laying method are based on a laying device (7) that folds a delivered fiber web (4) and forms a multilayer nonwoven fabric (14) on the discharge path (15) of a discharging conveyor (13) that runs transversely or at an angle to the feeding direction (26). The travel profile of the discharge path (15) is set in such a way as to vary in the discharge direction in the vertically projected zone below the web outlet (12) of the laying device.

20 Claims, 3 Drawing Sheets

(58) Field of Classification Search
USPC ..... 28/101
See application file for complete search history.

(56) References Cited

U.S. PATENT DOCUMENTS

| | | | | |
|---|---|---|---|---|
| 5,590,442 | A * | 1/1997 | Hirschek | D01G 25/00 19/163 |
| 6,434,795 | B1 * | 8/2002 | Jourde | D01G 25/00 19/161.1 |
| 6,662,407 | B2 * | 12/2003 | Bernhardt | D01G 25/00 19/161.1 |
| 2007/0175000 | A1 * | 8/2007 | Dilo | D01G 25/00 19/163 |
| 2008/0235915 | A1 * | 10/2008 | Dilo | D01G 25/00 19/296 |
| 2010/0084248 | A1 * | 4/2010 | Leger | D01G 25/00 198/617 |
| 2012/0180264 | A1 * | 7/2012 | Dilo | D01G 25/00 19/296 |
| 2013/0014349 | A1 * | 1/2013 | Dilo | D01G 25/00 19/296 |
| 2013/0198998 | A1 * | 8/2013 | Kuhn | D01G 25/00 19/163 |

FOREIGN PATENT DOCUMENTS

| | | | |
|---|---|---|---|
| EP | 1 828 453 | A1 | 9/2007 |
| EP | 1 828 453 | B1 | 6/2008 |
| EP | 2 175 056 | A1 | 4/2010 |
| JP | S62 117867 | A | 5/1987 |
| WO | 02/101130 | A1 | 12/2002 |
| WO | 2006/069651 | A1 | 7/2006 |

* cited by examiner

NONWOVEN LAYING APPARATUS AND NONWOVEN LAYING METHOD

CROSS REFERENCE TO RELATED APPLICATIONS

This application is a United States National Phase Application of International Application PCT/EP2014/073755 filed Nov. 5, 2014 and claims the benefit of priority under 35 U.S.C. § 119 of German Application 20 2013 104 946.8 filed Nov. 5, 2013, the entire contents of which are incorporated herein by reference.

FIELD OF THE INVENTION

The present invention pertains to a nonwoven laying apparatus especially a crosslaying apparatus and a nonwoven laying method having a laying device for folding over a delivered fibrous web and forming a multilayer nonwoven on a discharge path of a discharging conveyor running transversely or obliquely in relation to a feeding direction.

BACKGROUND OF THE INVENTION

Nonwoven laying apparatuses designed as crosslaying devices, which fold a delivered fibrous web with a laying device and deposit it on a discharge path of a discharging conveyor, which runs transversely or obliquely to the feeding direction, while a multilayer nonwoven is formed, are known from practice. The discharging conveyor is moving during the deposit of the fibrous web, so that the different layers of fibrous web form layer edges extending in a zigzag pattern in the nonwoven.

SUMMARY OF THE INVENTION

An object of the present invention is to provide an improved nonwoven laying technique.

The nonwoven laying technique according to the present invention, i.e., the nonwoven laying apparatus and the nonwoven laying method, have the advantage of improving laying quality and nonwoven quality. Interfering effects on the delicate fibrous web can be minimized or avoided during the fibrous web deposit on the discharging conveyor.

These improvements in quality also become noticeable, in particular, at increased travel speeds of the fibrous web at the intake into the nonwoven laying apparatus and during the deposit on the discharging conveyor. This fibrous web travel speed may be 200 m/minute or higher. On the other hand, the discharge speed of the discharging conveyor can also be increased, e.g., to 4 m/minute or more. This is especially advantageous when using a downstream high-speed device for further processing the nonwoven, especially a water jet strengthening device (so-called spunlace). On the whole, the velocity level of the nonwoven laying apparatus and the fiber processing unit and hence also the performance capacity and the economy can be significantly increased hereby. The nonwoven laying technique partly also makes possible such increases in velocity in the first place without impairment of the laying quality.

In particular, swirl formation in the fibrous web layers and the nonwoven as well as pumping effects due to the motions of the laying device, especially of a main carriage with laydown belts, can be minimized or avoided with the nonwoven laying technique being claimed. This is manifested in an especially high quality of the layer edges or lateral edges of the fibrous web layers in the nonwoven. Folding over or swirling of these delicate edge areas of the fibrous web layers can be prevented.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
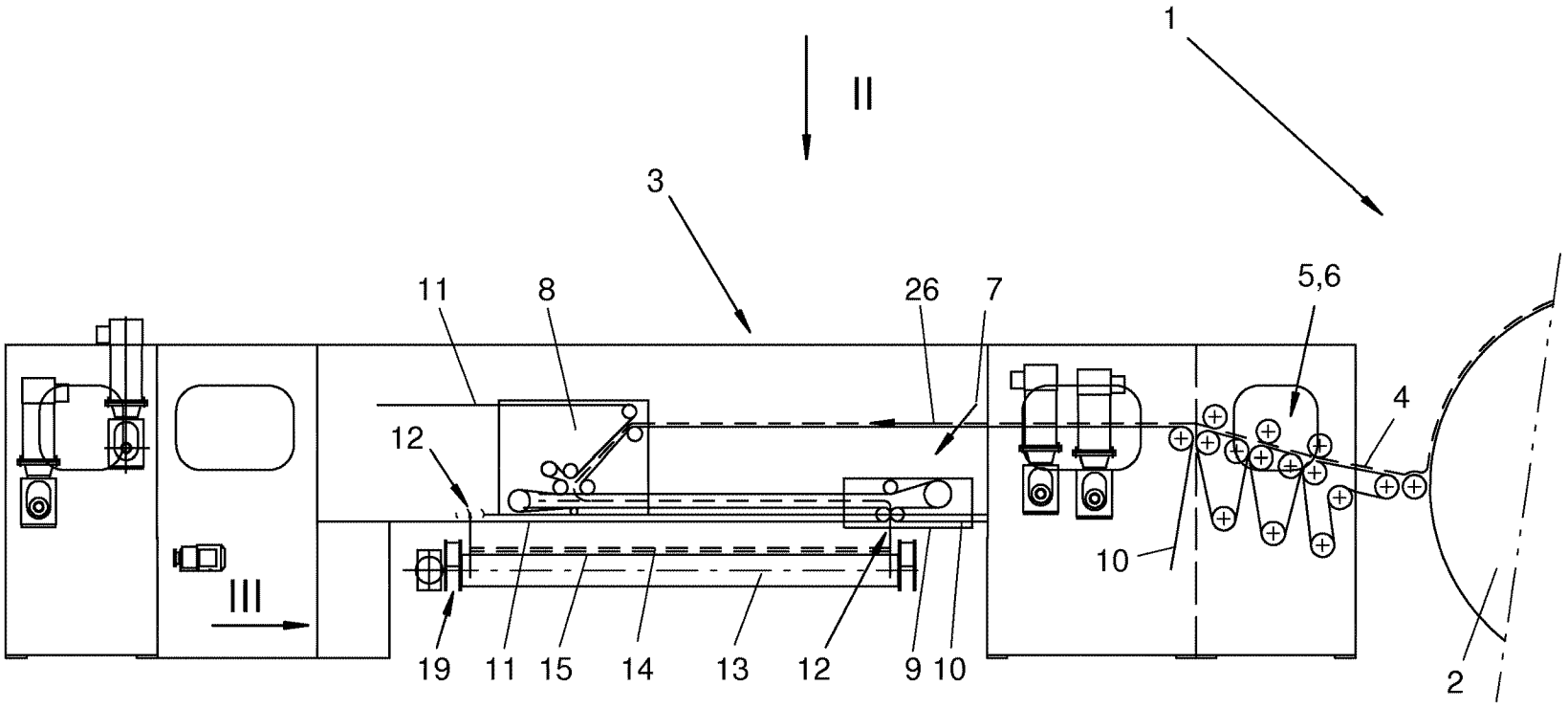
FIG. 1 is a front view showing a nonwoven laying apparatus with a laying device and with a discharging conveyor.

Referring to the drawings, the present invention pertains to a nonwoven laying apparatus (3) and a nonwoven laying method. The present invention pertains, furthermore, to a fiber processing unit (1) with such a nonwoven laying apparatus (3).

The nonwoven laying apparatus (3) is preferably designed as a crosslaying apparatus. It takes up a fibrous web (4) fed from a formed fabric generator (2) by means of a feeding device (5) and folds this while forming a multilayer nonwoven (14), wherein the nonwoven (14) is deposited on the discharge belt (discharge path device) (15) of a discharging conveyor (13) and is removed from this. The feeding direction (26) of the fibrous web (4) and the discharge direction (27) of the nonwoven (14) and of the discharging conveyor (13) may be directed transversely or obliquely to one another in the top view.

Figure 2:
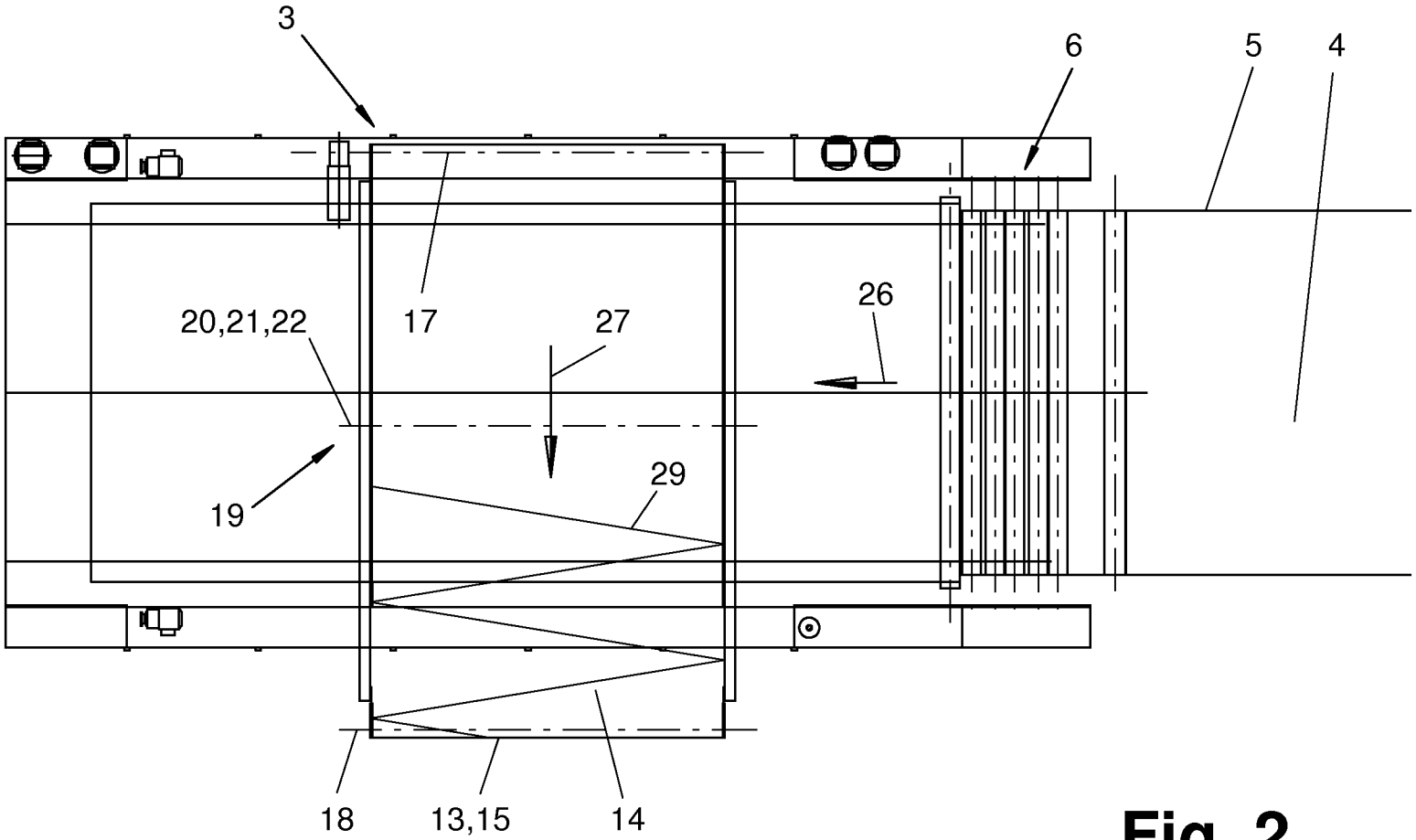
FIG. 2 is a top view of the nonwoven laying apparatus according to arrow II in FIG. 1.

The discharging conveyor (13) is moving during the fibrous web deposit in the discharge direction (27), as a result of which the fibrous web layers are deposited and laid in a zigzag path according to FIG. 2. They have oblique edges or so-called layer edges (29). The fibrous web deposit takes place in a controlled manner such that the layer edge (29) that is the front edge in the feeding direction comes to lie directly above a rear layer edge (29) of a fibrous web layer deposited previously. Exact closure of the layers is sought to be achieved.

The nonwoven laying apparatus (3) has a laying device (7), with which the fibrous web (4) being delivered is deposited on the transversely or obliquely running discharging conveyor (13). The laying device (7) has a web outlet (12), which is displaceable to and fro in the feeding direction (26) and from which the fibrous web (4) exits downwardly onto the discharge belt (path) (15) of the discharging conveyor (13) and the fibrous web layer(s) already deposited here.

The fibrous web (4) may consist of a fibrous web or a plurality of fibrous webs lying one on top of another. The fibers are preferably synthetic fibers consisting of plastic fibers, but they may also be, as an alternative, natural fibers or fiber blends from synthetic or natural fibers. The fibers may be present without or with a prevailing fiber orientation in the fibrous web (4). The fibrous web (4) may be in the form of a matted fibrous web or as a type of wad web. As an alternative, it may comprise a plurality of fiber strands arranged next to one another.

The deposited nonwoven (14) has two or more fibrous web layers. The nonwoven thickness depends on the number of layers. As an alternative, another fibrous web, on which the aforementioned fibrous web (4) is deposited and laid, may also be fed to the nonwoven laying apparatus (3) from another side, e.g., from the rear side of the discharging conveyor.

The nonwoven laying apparatus or crosslaying device (3) and its laying device (7) may have various designs. The drawings show a belt type laying apparatus, whose laying device (7) is formed by two main carriages (8, 9) located one on top of another and by two laydown belts (10, 11), which are guided each in an endless loop over deflecting rollers at the main carriages (8, 9) and deflecting rollers at the machine frame (not shown). The main carriages (8, 9) and the laydown belts (10, 11) are provided with controlled drives.

The laydown belts (10, 11) take up between them the delivered fibrous web (4) at the upper main carriage (8) or upper carriage and deliver it in bilateral contact and in clamping connection to the lower main carriage (9) or laying carriage. The laydown belts (10, 11) separate again from one another at the web outlet (12) of the latter carriage via deflecting rollers located there and are spread out in opposite directions transversely over the discharging conveyor (13) and the nonwoven (14), while they cover the nonwoven (14) upwardly. The web outlet (12) is symbolized in FIG. 3 by a deflecting roller in a lateral view.

The main carriages (8, 9) move above the discharging conveyor (13) and to and fro transversely or obliquely to the discharge direction (27). The laying carriage (9) with the web outlet (12) always slows down at the end of its path of motion and above the edge of the discharging conveyor (13), which edge is located there, stops and accelerates again in the opposite direction. FIG. 1 shows both end positions of the web outlet (12).

In addition, the nonwoven laying apparatus (3) may have a tensioning device for the laydown belts (10, 11) with one or more auxiliary carriages (not shown), which are optionally coupled with a main carriage. Different loop lengths of the laydown belts (10, 11) can be taken up by means of the tensioning device and maintained under tension, which can develop due to an uncoupling of the motions of the main carriages (8, 9). The nonwoven laying apparatus (3) may be designed as a laying apparatus running in the same direction or in opposite directions, in which the main carriages (8, 9) move each in the same direction or in opposite directions. The arrangement of the carriages and belt of such a nonwoven laying apparatus (3) running preferably in the same direction may be designed, e.g., corresponding to EP 1 828 453 A1.

The discharging conveyor (13) is designed as a belt conveyor in the exemplary embodiment being shown and has an endless, circulating discharging conveyor, which is guided via a plurality of, e.g., two deflecting rollers (17, 18) and is driven with a circulating motion. The discharging conveyor (13) may be designed as a lattice belt, as a screen belt or in another suitable manner. The discharge belt (path) (15) is formed by the upper run of the discharging conveyor (13). The lower run (16) may have a slack. The discharging conveyor (13) is driven in a circulating manner by a controlled drive, not shown, with the upper run (15) moving in the discharge direction (27). The speed of delivery can be adapted proportionally to the travel speed of the web outlet (12).

In another alternative embodiment, the discharging conveyor (13) may be designed as a roller conveyor. The discharge belt (path) (15) is formed now, e.g., by a support surface and a plurality of rollers, which are arranged there and are driven in a controlled manner. The discharging conveyor (13) and its discharge belt (path) (15) may otherwise have any design embodiment.

The web outlet (12) has a width, viewed in the discharge direction (27), which corresponds to the web width of the fibrous web (4) or the carding width. The discharging conveyor (13) may have a length extending beyond the front edge of the web outlet (12).

Figure 3:
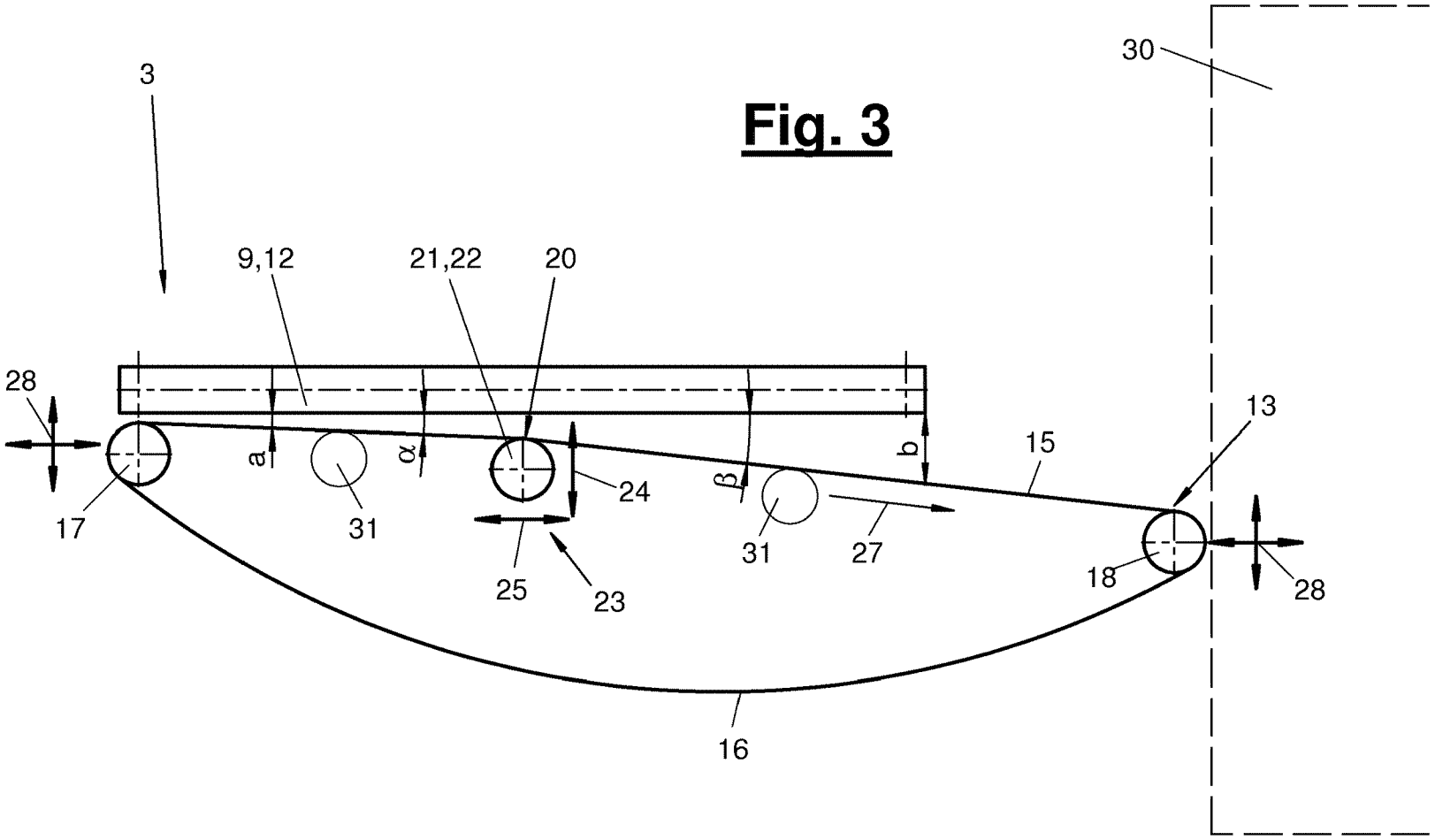
FIG. 3 is a side view of the discharging conveyor according to arrow III in FIG. 1.

As is shown in FIG. 3, the discharging conveyor (13) has a device (19) for setting a travel profile of the discharge belt (path) (15) in the vertically projected area under the web outlet (12) of the laying device (7), wherein this travel profile varies in the discharge direction (27). Different gap widths (a, b) are obtained between the web outlet (12) and the discharge belt (path) (15) due to the varying travel profile.

The discharge belt (path) (15) may have a generally obliquely downwardly directed slope. For example, the deflecting rollers (17, 18) are arranged for this at different levels, e.g., in the discharge belt (path) (13) shown. The rear deflecting roller (17) is located at the rear edge of the web outlet (12) and is arranged above the front deflecting roller (18). The front deflecting roller (18) may be equipped with an adjusting means (28) for changing its height and possibly also its horizontal lateral position. The rear deflecting roller (17) may also have such a monoaxial or biaxial adjusting means (28).

The travel profile of the discharge belt (path) (15) can be set and possibly also reset along one or more adjusting axes (24, 25) by means of an adjusting device (23) in the areas under the web outlet (12). One adjusting axis (24) is oriented, e.g., vertically and the other adjusting axis (25) is oriented horizontally, extending in the discharge direction (27). The design embodiment and arrangement of the adjusting device (23) depends on the design embodiment of the discharging conveyor (13) and the discharge belt (path) (15) thereof.

The travel profile of the discharge belt (path) (15) has, in the area under the web outlet (12), a bending or jump point (20), at which the profile changes gradually or abruptly. The bending or jump point (20) is preferably located in the middle area of the width of the web outlet (12) in the discharge direction (27). The position of a bending or jump point (20) of the travel profile of the discharge belt (path) (15) can be set and optionally adjusted by means of the adjusting device (23) along one or more axes (24, 25), especially vertically and/or horizontally.

Furthermore, one or more supporting rollers (31) may be arranged under the discharge belt (path) (15) according to FIG. 3. They are used to support the nonwoven and reduce or avoid the sagging of the nonwoven. They may likewise be adjustable along one or more axes, especially vertically and horizontally. Their position in the discharge direction (27) may depend on the number of layers of the nonwoven (14) and the width of the layers in the discharge direction (27).

In another embodiment of the discharging conveyor, not shown, the deflecting roller (17) may, furthermore, be moved to the rear from the projection area of the web outlet (12), and a supporting roller (31) will assume its position shown in FIG. 3, instead.

As is shown in FIG. 3, the travel profile of the discharge belt (path) (15) has different slope angles (α, β) in the area under the web outlet (12). These angles may be directed against the horizontal or against the likewise horizontal web outlet (12) and downwardly. The slope angle (α) pertains to the rear area of the discharge belt (path) (15) up to the bending or jump point (20). The slope angle (β) pertains to the front area of the discharge belt (path) (15) starting from the bending or jump point (20) when viewed in the discharge direction (27).

The slope angle (α) may equal 0°, and the rear area of the discharge belt (path) (15) is directed horizontally and parallel to the web outlet (12). The slope angle (α) is greater than 0° in the exemplary embodiment. This results in a gap width (a) increasing in the discharge direction (27) in the rear area of the discharge belt (path) (15).

The slope angle (β) is greater than the slope angle (α). The downwardly directed slope angle (β) of the belt (15) increases greatly as a result behind the bending or jump point (20). The gap width (b) likewise increases starting from the bending or jump point (20). On the whole, an intermittently varying gap width (a, b) is obtained between the discharge belt (path) (15) and the web outlet (12).

The discharge belt (path) (15) has, according to FIG. 3, a course bent or angulated downwardly in the discharge direction (27) in the area under the web outlet (12). An individual bending or jump point (20) is present in the exemplary embodiment shown. As an alternative, two or more such points may be present. The travel profile formed hereby may have a correspondingly angulated or softer, rounded shape.

In the exemplary embodiment of a discharging conveyor (13) shown, the adjusting device (19) for the travel profile has an adjustable support device (21) arranged under the web outlet (12) for the discharge belt (path) (15), especially for the upper run. The support device (21) is preferably designed as a rotatable supporting roller (22) in the belt conveyor. As an alternative, the support device (21) may be a support beam or another support element with a surface favorable for friction for the circulating discharging conveyor (13).

In addition, other design variants are possible. A roller conveyor may be divided over its length, e.g., into a plurality of conveyor sections connected to one another in an articulated manner. The travel profile can be set and possibly adjusted by pivoting and raising/lowering the belt sections.

The support device (21) is connected to a monoaxial or multiaxial (24, 25) adjusting device (23). For example, the supporting roller (22) can be adjusted for this vertically and horizontally with a cross slide arrangement via the adjusting axes (24, 25) according to the discharge direction component. As an alternative, a monoaxial adjustment is possible, e.g., via a pivot axis or via an individual slide with horizontal, vertical or oblique direction of motion.

The travel profile and the position of the one or more bending or jump points (20) may depend on the number of layers in the nonwoven (14) and adapted correspondingly. A more or less central arrangement relative to the web outlet (12) is advantageous for a two-layer nonwoven (14). Special advantages arise in this case for the rear oblique layer edge or lateral edge (29) of the web layer deposited straight. If the web outlet (12) or the lower main carriage (9) slows down at the end of its transverse motion over the discharging conveyor (13), stops, and then accelerates again in the opposite direction, the rear layer edge (29) is completely or at least mostly in the rear area of the discharge belt (path) (15), where the gap width (a) is relatively small and vibration and pumping effects of the web outlet (12) or of the spread-out laydown belts (10, 11) have very little or no effect and may lead to swirling or folding over of the rear layer edge (29).

In case of a two-layer nonwoven (14), the first fiber web and the fiber web deposited during the forward travel of the web outlet (12) is transported by a section in the discharge direction (27), which corresponds to said half of the width of the web outlet (12) or to half the width of the fibrous web (4). The bending or jump point (20) is correspondingly positioned approximately in the middle of the web outlet width or somewhat behind it in the discharge direction (27). If the nonwoven (14) has three or more web layers, the bending or jump point (20) or the support device (21) can be moved correspondingly to the rear against the discharge direction (27). This can be brought about via the horizontal adjusting axis (25) of the adjusting device (23).

The changes in the gap width (a) and the slope angles (α) can be set via the vertical adjusting axis (24) and optionally the adjusting means (28) of the rear deflecting roller (17). This makes possible an adaptation to different numbers of layers in the nonwoven (14) and also to different thicknesses of the fibrous web (4). A setting or also a change may be performed, furthermore, for adaptation to different web travel speeds and nonwoven laying apparatus speeds.

The gap width (b) can increase to a greater extent and superproportionally in the discharge direction (27) after the bending or jump point (20) or the slope angle (β) can increase markedly, so that the multilayer nonwoven (14) can be removed without constraints.

In case of a two-layer nonwoven (14), for example, the distance (a) may be constant and the angle α may equal 0°. The distance (a) may have a value of, e.g., 0-5 mm. The laydown belt (10, 11) lies on the nonwoven (14) at a distance of 0 mm. The distance (a) may also depend on the type and sensitivity of the fibrous web (4), the web thickness, the laying speed, etc. The distance (a) may, furthermore, increase with the number of layers in case of a nonwoven (14) with three or more layers.

The distance (b) between the end of the web outlet (12) in the discharge direction (27) and the discharge belt (path) (15) or the upper run may be, e.g., between 20 mm and 900 mm or more. The lower value range applies to two-layer nonwovens (14), and the distance (b) also increases with increasing number of layers.

The nonwoven (14) may be delivered from the discharging conveyor (13) to a downstream further processing unit (30), indicated in FIG. 3, especially a strengthening device. Such a strengthening device may be, e.g., a needling machine, a thermal strengthening device, a water jet strengthening device or the like. As an alternative, the nonwoven (14) may also be wound up or subjected to aftertreatment in another way.

The profile of the nonwoven (14) on the discharging conveyor (13) can be affected in the cross section and/or in the longitudinal section, and regulation is also possible. This may serve various purposes, e.g., a preventive compensation of effects of changes in a strengthening device. A profiling device (6) may be arranged upstream of and/or associated with the laying device (7) to affect the profile of the nonwoven. There are various embodiment possibilities for this.

A profiling device (6) may be integrated in the nonwoven laying apparatus (3) and it controls the amount of web being discharged at the web outlet (12) during the travel motion of the web outlet (12). The profile of the nonwoven and the area weight of the nonwoven (14) are changed in the transverse and/or longitudinal direction by depositing more or less fibrous web. Another possibility of profiling is to generate thin areas or thickened areas in the fibrous web (4) being fed to the nonwoven laying apparatus (3). A profiling device (6) may be designed for this, e.g., as a stretching device, which generates thin areas by stretching and deposits these in the desired areas in the nonwoven (14). These may be, e.g., the edge areas of the nonwoven in order to avoid edge accumulations there. FIG. 1 shows, e.g., such a stretching device (6) in the intake area of the nonwoven laying apparatus (3). Such a stretching device (6) may also be arranged between the nonwoven laying apparatus (3) and the formed fabric generator (2). A stretching device may have one or more, preferably two, three or more stretching zones with a corresponding number of clamping sites for the fibrous web (4).

FIG. 1 shows as an example a part of the fiber processing unit (1) mentioned in the introduction. The formed fabric generator (2) is designed here, e.g., as a carding engine, which discharges at an outlet a single-web or multiweb fibrous web (4), which is fed to the nonwoven laying apparatus (5) directly or by means of a feeding device arranged between them, and a stretching device (6) is also arranged between them. To compensate the fluctuating web speed occurring in a stretching device, a buffering device may be integrated in the nonwoven laying apparatus (3). As an alternative, it may be arranged upstream or downstream of the nonwoven laying apparatus (3). The aforementioned aftertreating device (30), especially strengthening device, may likewise be a part of the fiber processing unit (1). It is indicated only schematically in FIG. 3 for clarity's sake. It may have a delivery mechanism of its own for the nonwoven (14).

Various variants of the embodiments shown and described are possible. The features of these examples may be combined with one another or also exchanged with one another as desired. The nonwoven laying apparatus design may also vary, e.g., it may be a carriage type laying apparatus or a vertical laying apparatus or a so-called camelback laying apparatus. While specific embodiments of the invention have been shown and described in detail to illustrate the application of the principles of the invention, it will be understood that the invention may be embodied otherwise without departing from such principles.

The invention claimed is:

1. A nonwoven laying apparatus comprising:

a discharging conveyor with a discharge path;

a laying device for folding over a delivered fibrous web and forming a multilayer nonwoven on the discharge path of the discharging conveyor running with a discharge direction that is oriented transversely or obliquely in relation to a feeding direction, wherein the discharging conveyor has a travel profile setting device for setting a travel profile of the discharge path, which travel profile varies in the discharge direction, in a vertically projected area under a web outlet of the laying device, wherein:

the travel profile of the discharge path has a bending or jump point in the vertically projected area under the web outlet; and the bending or jump point of the travel profile is essentially in a middle area of a width of the web outlet when viewed in the discharge direction.

2. A nonwoven laying apparatus in accordance with claim 1, wherein the travel profile setting device comprises an adjusting device wherein the travel profile of the discharge path can be set and adjusted in the vertically projected area under the web outlet by the adjusting device along one or more axes vertically or horizontally or any combination of along one or more axes, vertically and horizontally.

3. A nonwoven laying apparatus in accordance with claim 1, wherein the travel profile of the discharge path can be set and optionally adjusted in the vertically projected area under the web outlet as a function of the number of layers of the nonwoven.

4. A nonwoven laying apparatus in accordance with claim 1, wherein the travel profile setting device comprises an adjusting device wherein a position of a bending or jump point of the travel profile in the vertically projected area under the web outlet can be set and optionally adjusted by the adjusting device along one or more axes, vertically or horizontally or any combination of along one or more axes, vertically and horizontally.

5. A nonwoven laying apparatus in accordance with claim 1, wherein the travel profile of the discharge path in the vertically projected area under the web outlet has different slope angles.

6. A nonwoven laying apparatus in accordance with claim 1, wherein a gap width between the discharge path and the web outlet varies intermittently.

7. A nonwoven laying apparatus in accordance with claim 1, wherein the discharging conveyor is configured as a circulating discharging conveyor and the discharge path is configured as an upper run thereof.

8. A nonwoven laying apparatus in accordance with claim 1, wherein:

the travel profile setting device comprises an adjustable support device arranged under the web outlet for acting on a run of the discharge path and comprises a monoaxial or multiaxial adjusting device; and the adjustable support device is connected to the monoaxial or multiaxial adjusting device.

9. A nonwoven laying apparatus in accordance with claim 1, wherein the laying device has a plurality of main carriages movable transversely and reversingly above the discharging conveyor and a plurality of endless laydown belts guided via deflecting rollers at the main carriages, whereby a lower main carriage has a web outlet for the fibrous web between the laydown belts.

10. A nonwoven laying apparatus in accordance with claim 1, wherein a downwardly directed slope angle of the discharge belt in the vertically projected area under the web outlet increases in the discharge direction behind the bending or jump point.

11. A nonwoven laying apparatus in accordance with claim 8, wherein the support device is configured as a rotatable supporting roller.

12. A nonwoven laying apparatus in accordance with claim 1, wherein the discharge path has a downwardly bent or angulated course in the discharge direction in the vertically projected area under the web outlet, whereby a gap width between the discharge path and the web outlet increases in the discharge direction behind the bending or jump point.

13. A nonwoven laying apparatus in accordance with claim 1, wherein the discharge path has a basic slope directed obliquely downwardly in the discharge direction in the vertically projected area under the web outlet.

14. A fiber processing unit comprising a formed fabric generator for producing a fibrous web and comprising a nonwoven laying apparatus for forming and discharging a multilayer nonwoven, the nonwoven laying apparatus comprising:

a discharging conveyor with a discharge path;

a laying device for folding over a delivered fibrous web and forming a multilayer nonwoven on the discharge path of the discharging conveyor running with a discharge direction that is oriented transversely or obliquely in relation to a feeding direction wherein the discharging conveyor has a travel profile setting device for setting a travel profile of the discharge path, which travel profile varies in the discharge direction, in a vertically projected area under a web outlet of the laying device, wherein:

the travel profile of the discharge path has a bending or jump point in the vertically projected area under the web outlet; and the bending or jump point of the travel profile is essentially in a middle area of a width of the web outlet when viewed in the discharge direction.

15. A fiber processing unit in accordance with claim 14, further comprising:

a profiling device, comprising a stretching device, arranged between the outlet of the formed fabric generator and the nonwoven laying apparatus; and a further processing device comprising a strengthening device, for the discharged nonwoven, arranged downstream of the nonwoven laying apparatus.

16. A method for laying a nonwoven by means of a nonwoven laying apparatus comprising a laying device, the method comprising the steps of:

folding over a delivered fibrous web with the laying device and forming a multilayer nonwoven on a discharge path of a discharging conveyor running with a discharge direction transversely or obliquely in relation to a feeding direction; and setting a travel profile of the discharge path, which travel profile varies in the discharge direction, in a vertically projected area under a web outlet of the laying device;

setting a variation of the travel profile of the discharge path in the vertically projected area under the web outlet of the laying device; and providing the variation of the travel profile of the discharge path in the vertically projected area under the web outlet with a bending or jump point, which bending or jump point is arranged approximately in a middle area of a width of the web outlet when viewed in the discharge direction.

17. A method in accordance with claim 16, wherein the travel profile of the discharge path is set and optionally adjusted in the vertically projected area under the web outlet by means of an adjusting device along one or more axes, or vertically or horizontally or any combination of along one or more axes, vertically and horizontally.

18. A method in accordance with claim 16, wherein:

a gap between the discharge path and the web outlet has a gap width;

the travel profile of the discharge path and the gap width are set and optionally adjusted in the vertically projected area under the web outlet as a function of a number of layers of the nonwoven.

19. A method in accordance with claim 16, wherein a position of a bending or jump point of the travel profile under the web outlet is set and optionally adjusted by means of an adjusting device along one or more axes or vertically or horizontally or any combination of along one or more axes, vertically and horizontally.

20. A method in accordance with claim 16, wherein:

a gap between the discharge path and the web outlet has a gap width;

different slope angles are set in the travel profile of the discharge path in the vertically projected area under the web outlet; and a downwardly directed slope angle and the gap width increase behind the bending or jump point in the travel profile when viewed in the discharge direction.

* * * * *